US010837393B2

(12) United States Patent
Behrendt

(10) Patent No.: US 10,837,393 B2
(45) Date of Patent: Nov. 17, 2020

(54) METHOD FOR OPERATING A DIESEL ENGINE

(71) Applicant: CONTINENTAL AUTOMOTIVE GMBH, Hannover (DE)

(72) Inventor: Gerald Behrendt, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 289 days.

(21) Appl. No.: 15/621,277

(22) Filed: Jun. 13, 2017

(65) Prior Publication Data

US 2017/0276087 A1 Sep. 28, 2017

Related U.S. Application Data

(63) Continuation of application No. PCT/EP2015/079189, filed on Dec. 10, 2015.

(30) Foreign Application Priority Data

Dec. 15, 2014 (DE) ..... 10 2014 225 920

(51) Int. Cl.
*F02D 41/38* (2006.01)
*F02D 41/24* (2006.01)
(Continued)

(52) U.S. Cl.
CPC ..... *F02D 41/3845* (2013.01); *F02D 41/123* (2013.01); *F02D 41/2432* (2013.01);
(Continued)

(58) Field of Classification Search
CPC ..... F02D 41/3845; F02D 41/3809; F02D 41/123; F02D 41/3827; F02D 41/3082;
(Continued)

(56) References Cited

U.S. PATENT DOCUMENTS 6,367,454 B1 4/2002 Rembold et al.
8,534,265 B2 * 9/2013 Saruwatari ..... F02D 41/2438 123/497
(Continued)

FOREIGN PATENT DOCUMENTS

CN 101198784 A 6/2008
CN 102159821 A 8/2011
(Continued)

OTHER PUBLICATIONS

International Search Report and Written Opinion dated Mar. 1, 2015 from corresponding International Patent Application No. PCT/EP2015/079189.
(Continued)

*Primary Examiner* — Hung Q Nguyen

(57) ABSTRACT

A method for operating an engine in which fuel is supplied to the engine by a fuel pump and by a high-pressure fuel pump, and in which the speed of the fuel pump and/or the electrical current for feeding the fuel pump is controlled in accordance with a requirement variable, taking into account a determination specification. When the engine has changed to an overrun mode of operation, a calibration is performed and the speed of the fuel pump is detected and is maintained. Once the triggering pressure for a calibration valve has been reached, the pump current is detected, a bypass volumetric flow rate of the high-pressure fuel pump is determined during calibration using operating parameters and the triggering pressure for the calibration valve, the determined speed, the bypass volumetric flow rate and the determined pump current are used to calibrate the determination specification.

16 Claims, 2 Drawing Sheets

(51) Int. Cl.

| | |
|---|---|
| ***F02D 41/30*** | (2006.01) |
| ***F02D 41/12*** | (2006.01) |
| ***F02M 37/00*** | (2006.01) |
| ***F02M 37/08*** | (2006.01) |

(52) U.S. Cl.
CPC ..... *F02D 41/3082* (2013.01); *F02D 41/3809* (2013.01); *F02D 41/3827* (2013.01); *F02M 37/0023* (2013.01); *F02M 37/08* (2013.01); *F02D 2200/021* (2013.01); *F02D 2200/101* (2013.01)

(58) Field of Classification Search
CPC ..... F02D 41/2432; F02D 2200/101; F02D 2200/021; F02M 37/08; F02M 37/0023
See application file for complete search history.

(56) References Cited

U.S. PATENT DOCUMENTS

2010/0274467 A1* 10/2010 Hayami ..... F02D 41/2438 701/103
2011/0162622 A1* 7/2011 Kojima ..... F02D 41/062 123/457
2011/0259300 A1 10/2011 Anetsberger et al.
2012/0097132 A1* 4/2012 Suda ..... F02D 33/006 123/457
2012/0132177 A1 5/2012 Kristen et al.
2014/0105758 A1 4/2014 Sausner et al.

FOREIGN PATENT DOCUMENTS

| | | | |
|---|---|---|---|
| CN | 102203405 | A | 9/2011 |
| DE | 19853823 | A1 | 5/2000 |
| DE | 10149237 | A1 | 4/2003 |
| DE | 102004006694 | A1 | 8/2005 |
| DE | 102007033858 | A1 | 1/2009 |
| DE | 102007057452 | A1 | 6/2009 |
| DE | 102008018603 | A1 | 10/2009 |
| DE | 102010030872 | A1 | 1/2012 |
| JP | 2007211652 | A | 8/2007 |
| WO | 2012089400 | A1 | 7/2012 |

OTHER PUBLICATIONS

German Office Action dated Jun. 12, 2015 for corresponding German application No. 10 2014 225 920.7.

* cited by examiner

METHOD FOR OPERATING A DIESEL ENGINE

CROSS-REFERENCE TO RELATED APPLICATIONS

This application claims the benefit of PCT Application PCT/EP2015/079189, filed Dec. 10, 2015, which claims priority to German Application DE 10 2014 225 920.7, filed Dec. 15, 2014. The disclosures of the above applications are incorporated herein by reference.

FIELD OF THE INVENTION

The present invention lies in the field of mechanics and mechanical engineering and is used in automotive engineering, but also in other fields in which internal combustion engines are used. Furthermore, the present invention relates to a method for operating an internal combustion engine using a fuel pump.

BACKGROUND OF THE INVENTION

In modern motor vehicles which are driven by means of internal combustion engines or are at least partially driven by means of internal combustion engines, use is normally made of engines which are supplied with fuel by means of a fuel pump, wherein the operating parameters of the fuel pump are controlled for an optimization of the operation in a manner dependent on ambient conditions and on a load demand. In particular, it is important here for a certain fuel pressure to be generated on the engine side (pressure side) of the fuel pump.

For this purpose, it is also known for high-pressure pumps for fuel to be controlled on the basis of characteristic maps. Such a method is described for example in the German laid-open specification DE 198 53 823 A1 for a high-pressure pump. In this document, a pump of the mentioned type is controlled by means of a characteristic map such that a setpoint pressure is attained in a pressure accumulator.

The German laid-open specification DE 101 49 237 A1 has disclosed a regulation method for operating an internal combustion engine with direct injection, in which regulation method a switch may be made between multiple operating modes and the control of the high-pressure injection pump may be correspondingly selectively based on different characteristic curves.

For methods for pump control, in particular for fuel pumps which, in a vehicle, deliver fuel for example from a tank into a low-pressure circuit to a high-pressure pump, it is sought to achieve the following aims as part of a further optimization:

Firstly, it is sought to dispense with a direct pressure measurement by means of a sensor in the low-pressure circuit, that is to say between the fuel pump and a high-pressure pump or, expressed more simply, on the pressure side of the fuel pump, in order to reduce costs and outlay in terms of construction. Therefore, methods are used which determine and set the pressure on the pressure side of the fuel pump in the low-pressure circuit, that is to say upstream of the high-pressure pump, by means of the operating parameters of the fuel pump and other influential variables using determination methods and/or characteristic maps.

On the other hand, such determination methods and characteristic maps are subject to change as a result of wear of pump parts and other parts of the high-pressure circuit, and furthermore, it is not possible for all influential variables to be directly measured and included in a multi-dimensional characteristic map.

For this reason, a restriction to one characteristic map of the fuel pump is normally implemented, and it is sought to adapt the characteristic map, by means of a calibration measurement, to the other variables not resolved in the characteristic map and to the other influences. The required calibration measurements may for example be performed when the internal combustion engine is set in operation, for example upon the start of a journey with a motor vehicle, and refined by means of further calibration measurements.

For example, provision may be made for a reference valve to be provided between a pump and the internal combustion engine, the pressure behavior of which reference valve is known, that is to say which reference valve opens when a certain reference pressure is exceeded. Such a valve may be driven by means of targeted variation of operating parameters of the fuel pump such that the opening of the valve is identified and thus, under certain operating conditions, the attainment of the reference pressure may be registered. Such calibration methods may be supplemented and refined in order that not only the gradient of reference characteristic curves but also the spread of a characteristic map may be determined.

In the calibration of a diesel internal combustion engine, during overrun operation, the problem furthermore arises that the high-pressure pumps used in conjunction with such engines, even in the state in which the engine does not consume any fuel, nevertheless deliver a fuel quantity, which may be referred to as bypass volume flow and which practically flushes, cools and lubricates the high-pressure pump. The volume flow required for this purpose is dependent, inter alia, also on the mechanical tolerances, the prevailing pressure and the degree of wear of the diesel high-pressure pump. Since the flushing quantity is thus difficult to determine, the calibration of such a system, if it performs the pressure determination on the basis of a reference valve on the pressure side of the fuel pump upstream of the high-pressure pump in the low-pressure circuit, is difficult, because the calibration point of the fuel pump is jointly dependent on the bypass delivery quantity, which is difficult to determine. Specifically in the lower, typical working range of the delivery quantities, flushing quantities of diesel high-pressure pumps of between 8-30 l/h are encountered.

SUMMARY OF THE INVENTION

The present invention is thus based on the object of providing a method for the calibration and operation of an internal combustion engine, in which method fuel is supplied to the internal combustion engine by means of a fuel pump, and, the fuel system has a return line to the tank, and wherein, for the pressure determination, a calibration valve on the pressure side of the fuel pump, between the latter and a high-pressure pump, is used.

According to the invention, a method of the type mentioned in the introduction is provided, in which method fuel is supplied to the internal combustion engine by means of a fuel pump and by means of a high-pressure pump arranged between the fuel pump and the internal combustion engine, and in which method the rotational speed of the fuel pump and/or the electrical current for feeding the fuel pump (pump current) is controlled in a manner dependent on a demand variable, taking into consideration a determination specification, including a characteristic map, and in which method, in the event of a change in operating mode to overrun operation, a calibration is performed, wherein the fuel pump is actuated such that the pressure on its pressure side increases, that, in the event of a change in operating mode to overrun operation, the rotational speed of the fuel pump is detected and is maintained substantially unchanged, that, in the event of the triggering pressure of a calibration valve arranged on the pressure side of the fuel pump being attained, the pump current is detected, a bypass volume flow of the high-pressure pump which is delivered by the fuel pump is determined during the calibration on the basis of operating parameters, and the triggering pressure of the calibration valve, the determined rotational speed, the bypass volume flow and the determined pump current are used for the calibration of the determination specification.

By virtue of the fact that the rotational speed of the fuel pump is kept substantially constant, it may be possible for any irregularity that would arise as a result of a decrease of rotational speeds of the fuel pump, and which would be perceptible to a driver, to be avoided. Instead, an "overshoot" process that commonly occurs upon a change to overrun operation is utilized, which "overshoot" process consists in the fact that the absence of extraction of fuel by the engine in overrun operation leads to an overshoot of the fuel pressure on the pressure side of the fuel pump in the low-pressure circuit upstream of the high-pressure pump. Upon the overshoot of the pressure, a reference valve is triggered, which limits the pressure and discharges fuel back into a fuel tank. If the rotational speed of the fuel pump is kept constant during the calibration process it is thus possible for the triggering pressure of the calibration valve to be determined on the basis of the pump current, which, when the triggering pressure is reached, henceforth increases only slightly or remains constant.

The reference valve is situated in the low-pressure circuit on the pressure side of the fuel pump, between the latter and a high-pressure pump or the engine, and the tank. In the case of diesel-powered motor vehicles, there is typically a return line from the low-pressure circuit to the tank, into which fuel is recirculated from the high-pressure circuit, for example from the injectors or from a valve out of the high-pressure circuit. The high-pressure side of the high-pressure pump is thus also connected to a return line to the tank.

The return quantity, together with the excess fuel from the high-pressure rail/injectors, is conducted by the high-pressure pump via a pressure reducer into the return line.

In the case of fuel systems with a return/recirculation of fuel from the region of the injection to the tank, the problem exists that, for more exact determination of the triggering pressure of the reference valve, the volume flow through the reference valve itself should be taken into consideration. For the determination of the volume flow, however, it is necessary to determine the bypass volume flow of the high-pressure pump, because the bypass volume flow is provided, together with the volume flowing out through the reference valve, by the fuel pump. Furthermore, if a quantity extracted by the engine is greater than zero, it is also advantageously possible for the fuel extraction flow of the engine to additionally be determined and added to the bypass volume flow in order to determine the correction variable for the triggering pressure of the calibration valve. The bypass volume flow or possibly the sum of the two flows may be determined by means of operating parameters of the fuel pump and a provisionally assumed value of the switching pressure of the calibration valve.

Thus, according to the invention, firstly the bypass volume flow and possibly also the fuel extraction flow of the engine are determined on the basis of operating parameters and, from the bypass volume flow or possibly from the sum of the two volume flows, together with other variables, for example the rotational speed and the pump current of the fuel pump, the more exact triggering pressure of the calibration valve is calculated. If the triggering pressure is known, then the corresponding data triplet composed of the triggering pressure, the rotational speed and the pump current may be used as a dataset for a calibration of the fuel pump.

In one refinement, the bypass volume flow may be determined by virtue of the volume delivered by means of the fuel pump being compared with the volume actually burned by the engine. Both factors are self-evidently dependent on fuel pressure, engine rotational speed and temperature. Based on these parameters, during ongoing operation, data are continuously collected which permit the determination of the bypass volume flow under different conditions.

An advantageous refinement of the invention provides that, during the calibration, before, when or after the triggering pressure of the calibration valve is reached, the bypass volume flow of the high-pressure pump is determined taking into consideration an estimated pressure value on the pressure side of the fuel pump and/or the rotational speed of the fuel pump.

In this embodiment of the invention, it is firstly the case that the bypass volume flow of the pump or the sum of bypass volume flow of the pump and fuel extraction flow of the engine, is determined taking into consideration an initially estimated pressure value. The triggering pressure of the reference valve is known at least approximately, and is not so heavily dependent on the volume flow that an expedient estimated value could not be assumed. Assuming the triggering pressure is 6 bar, and a volume of 20 l/h is delivered, with a tolerance of 10 l/h, the triggering pressure of the reference valve would change by typically 0.1 bar. The triggering pressure may furthermore be dependent on the rotational speed of the fuel pump, which likewise normally defines a delivery quantity of the pump.

It may advantageously also be provided that the temperature and/or the rotational speed of the internal combustion engine are/is taken into consideration in the determination of the bypass volume flow of the high-pressure pump. If the bypass volume flow has been estimated on the basis of the estimated triggering pressure of the calibration valve, then it is possible from the bypass volume flow, from a detected fuel extraction flow of the engine and the rotational speed of the pump, for the triggering pressure of the calibration valve to be calculated more exactly. The triggering pressure of the reference valve determined more accurately in this way is sufficiently accurate for a calibration.

For the execution of the calibration according to the invention, it is advantageous that the fuel pressure on the high-pressure side of the high-pressure pump is kept constant during the calibration process, because a change in the pressure at the fuel rail (the high-pressure supply line of the injectors) would also give rise to a change in the bypass volume flow through the recirculation line. In this way, the triggering pressure of the reference valve may be set in more stable fashion.

The invention may furthermore be advantageously refined in that, after identification of the change in operating mode to overrun operation, the rotational speed of the fuel pump is determined, and a calibration is performed only under the condition that a defined rotational speed threshold is exceeded.

It is expedient for the calibration to be performed in the event of an overshoot, for which, however, a certain minimum rotational speed of the fuel pump above a rotational speed threshold is necessary. If the rotational speed of the pump lies above the threshold, then the pressure in the low-pressure circuit on the pressure side of the fuel pump rises, owing to the rapidly decreasing extraction by the engine, to such an extent that the triggering pressure of the reference valve is reached.

It may advantageously also be provided that, after identification of the change in operating mode to overrun operation, the rotational speed of the fuel pump is determined, and the rotational speed is reduced, the pump is deactivated, under the condition that a defined rotational speed threshold is undershot. If the rotational speed of the pump lies below the overshoot range, then it is expedient for no calibration to be performed, and for the rotational speed to be lowered further, to zero, for the purposes of saving fuel.

The invention may also be refined such that, before or during a calibration, the rotational speed of the fuel pump is varied so as to assume a value from a predefined set of fixed values.

Calibration measurements may basically be performed at any rotational speed of the pump, though it may be provided that certain rotational speeds are used preferentially for the execution of a calibration measurement, for example rotational speeds for which characteristic curves are already stored in a memory. It may also be expedient, for the calibration, to select characteristic curves which assume prominent values, for example round values in the form of full hundreds of revolutions per minute.

Since it is normally the case that multiple calibration measurements are performed, it may also be expedient for certain equidistantly distributed values for rotational speeds of the pump at which corresponding calibration measurements should be performed to be defined. In this case, it is possible in the case of any calibration measurement for a rotational speed of the pump to be set which corresponds to one of the predefined values at which hitherto no calibration measurement has yet been performed.

It may furthermore advantageously be provided that, after the determination of a pump current, upon the triggering of the calibration valve, it is checked whether the number of calibration points has reached a predefined minimum number. If the number of calibration measurements is sufficient, it is possible to dispense with calibration measurements from the given point in time onwards.

Furthermore, it may advantageously be provided that, after the calibration, the rotational speed of the fuel pump is reduced. Minimal operation of the pump is required for the lubrication of the high-pressure components, also of the high-pressure pump, because these are mechanically coupled to the internal combustion engine and fuel is delivered even when no combustion is taking place.

A further advantageous embodiment of the invention may provide that, during an ongoing calibration, as soon as overrun operation is ended, as a result of a change in the demand variable, it is determined to what extent the calibration has progressed, the calibration is ended, and, in a manner dependent on the progress of the calibration, the determined values are weighted.

It may also advantageously be provided that, during an ongoing calibration, as soon as overrun operation is ended, as a result of a change in the demand variable, it is determined to what extent the calibration has progressed, the calibration is ended, and, in a manner dependent on the progress of the calibration, the determined values are not taken into consideration.

In order that a calibration process may be started as smoothly as possible upon the transition to overrun operation, it may furthermore advantageously be provided according to the invention that the change to overrun operation is transmitted to the pump controller by means of electronic signals, such as by means of a bus system. In this case, the change to overrun operation does not have to be identified by means of analysis of operating parameters of the fuel pump, it rather being possible for the operation to be identified for example by means of sensors at the accelerator pedal or at the internal combustion engine and to be communicated by means of an electrical signal line, such as a bus system.

In the calibration, it may advantageously be provided that, before or during a calibration, the rotational speed of the fuel pump is changed so as to assume a value from a predefined set of fixed values, in the case of which no calibration measurement has yet been performed.

Here, it may furthermore advantageously be provided that the rotational speed of the fuel pump is reduced in order to attain a value from the predefined set of fixed values, in the case of which no calibration measurement has yet been performed. The lowering of the rotational speed after the transition to overrun operation constitutes in this case an intermediate step for the further reduction of the rotational speed after the calibration measurement. Thus, the changes of the rotational speed of the pump are minimized.

The invention relates not only to a method of the type described above but also to a drive system having an internal combustion engine to which fuel is supplied by means of a rotating fuel pump and by means of a high-pressure pump with fuel return line, and in which the rotational speed of the fuel pump and/or the electrical current for feeding the fuel pump (pump current) is controlled in a manner dependent on a demand variable, taking into consideration a determination specification, a characteristic map, and having a calibration device for calibrating parameters of the determination specification, wherein the calibration device has:

- an actuation device which keeps the rotational speed of the fuel pump at a constant value,
- a detection device which detects the triggering of a calibration valve,
- a determination device which determines a bypass volume flow of the high-pressure pump on the basis of operating parameters,
- a measurement device which determines the pump flow, and a correction determining device which determines a correction variable of the determination specification from one or more calibrations.

What is particularly notable in this context is the determination device for determining the bypass volume flow of the pump, wherein the bypass volume flow serves, in the following step, together with the rotational speed of the pump, for the determination of an actual volume flow through a reference valve, and thus permits the more exact determination of the triggering pressure of the reference valve on the basis of the volume flow and a corresponding characteristic curve. Thus, the calibration after the transition to overrun operation on the basis of the overshoot method may also be used for diesel engines, the high-pressure pumps of which, in the case of modern common-rail injection systems, are distinguished by a significant flushing quantity/a bypass delivery volume. Here, the calibration on the basis of the overshoot method, such as after the transition to overrun operation, constitutes an advantageous refinement.

In practical terms, it is also possible for multiple calibration points to be measured, but the variation of the rotational speed of the fuel pump may possibly have the effect that the behavior is perceived as a disturbance.

A further embodiment of the invention may also provide that a variation of the rotational speed or the actuation of multiple calibration points is performed also during the overrun operation. Multiple calibration points measured in succession should then advantageously be measured, in the context of gradually decreasing rotational speeds.

Even in the case of only one reference point/calibration point which is defined by opening of the calibration valve in the event of an increase of the pressure beyond the opening switching pressure, it is possible, after the successful measurement and storage of the data, and by means of a reduction of the rotational speed, for a further point upon closure of the valve to be recorded. The reference/calibration point differs, with regard to the switching pressure, from the switching pressure for the valve opening by a known hysteresis in the case of otherwise identical conditions/parameters.

The data for the determination of the bypass volume flow, like other measurement values, do not have to be collected and processed in the pump control unit, it also being possible for the items of information to be divided between different units or to be collected and processed in the engine control unit or in a software module in some other assembly of the vehicle. The calibration process may also be controlled for example by the engine controller or by some other module.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
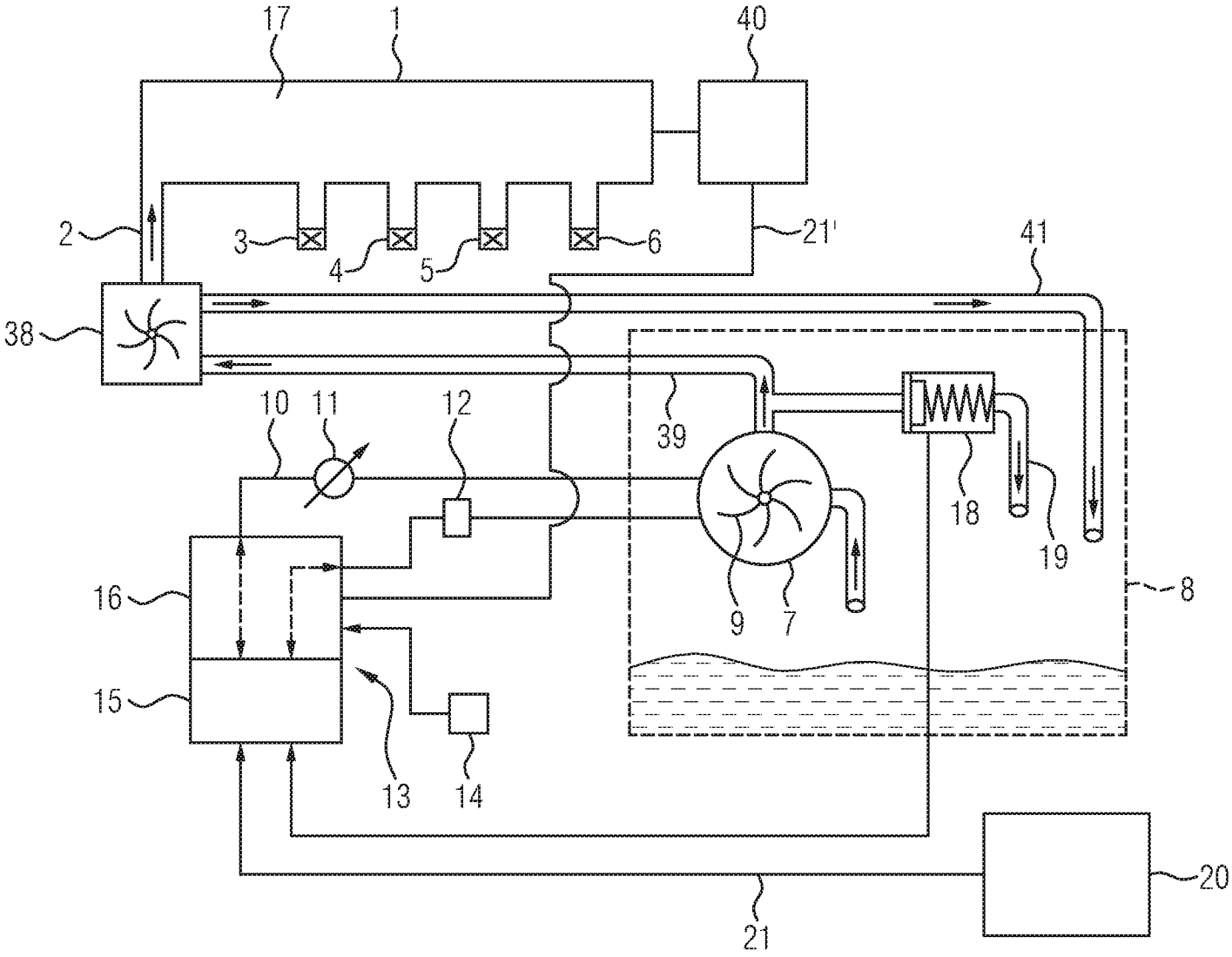
FIG. 1 schematically shows the construction of a diesel internal combustion engine, of a fuel pump and of corresponding control and sensor devices.

FIG. 1 shows an internal combustion engine 1 which is controlled by means of an engine controller (ECU) 40 and which, via a fuel line 2, is supplied with fuel at high pressure by means of the high-pressure pump/injection pump 38, wherein the fuel is injected into individual cylinders (not illustrated) by means of four injection valves 3, 4, 5, 6. For this purpose, fuel is supplied to the high-pressure pump 38 from a tank 8 via a low-pressure circuit 39 by means of the fuel pump 7. It is the intention in the method according to the invention to calibrate the fuel pump 7, which may be arranged in the tank 8. The pump 7 is driven by means of an electric motor integrated therein, and has a rotor 9 for delivering the fuel. The rotor is schematically illustrated, wherein, for example, a positive-displacement pump or some other rotor pump may be used as the pump.

The electric motor of the pump 7 is fed with a current (pump current) via an electrical line 10, wherein the current intensity is detected by means of a current sensor 11. The rotational speed of the pump is detected by means of a sensor 12 and transmitted to a control device 13 of the pump (pump controller). The control device 13 is actuated with the demand variable by means of an accelerator pedal 14, and, in the actuation of the pump 7, takes into consideration both the rotational speed of the pump rotor 9, which is transmitted by the sensor 12, and the current intensity of the pump flow. The rotational speed of the pump rotor 9, the current intensity of the pump current and the pressure in the low-pressure circuit between the fuel pump 7 and the high-pressure pump 38 are linked to one another by a characteristic map. For this purpose, the controller 13 has a data processing part 15 in which corresponding determination algorithms and/or characteristic maps are stored. The remaining part 16 of the control device 13 performs the direct actuation of the pump 7.

To the low-pressure circuit 39, which is at an elevated fuel pressure in relation to the tank 8 and situated between the fuel pump 7 at one side and the high-pressure pump 38 and the engine 1 at the other side, there is connected a reference valve 18, which may be arranged in the fuel tank 8 or else outside the tank and which, in the event of an exceedance of a reference pressure, opens and discharges fuel via an outlet duct 19. The reference valve 18 is used in the manner according to the invention for calibrating the controller 13 and/or the data processing part 15. The calibration process may be controlled by means of the engine controller 40 or the pump controller or a software module integrated in some other assembly of the vehicle.

Since the high-pressure pump 38, as a constituent part of a diesel common-rail injection system, normally permits a bypass volume flow, the high-pressure pump 38 is equipped with a return line, that is to say with a return duct 41 to the tank 8, via which return duct excess fuel flows back. The corresponding bypass volume flow, which is delivered through the fuel pump 7 on the path to the high-pressure pump 38 and flows through the low-pressure circuit 39, influences the triggering pressure of the calibration valve 18 and is thus, according to the invention, firstly determined and then taken into consideration in the calibration.

In addition to the input variables of the load demand from the accelerator pedal 14, the rotational speed of the pump 7, the pump current and possibly other influential variables such as the air humidity and the operating temperature, the control device 13 may also have the rotational speed of the internal combustion engine transmitted thereto from the stator or from the rotor 20 of the internal combustion engine. The engine or the engine controller may for example transmit a signal to the control device 13 via a CAN bus 21, 21', which signal signalizes the rotational speed and possibly the change to overrun operation. For identifying the overrun operation, it is additionally also possible to concomitantly process a signal from the accelerator pedal 14. The process of the calibration, which may take place both in normal operation and in overrun operation, will be discussed in more detail further below on the basis of FIG. 3.

Figure 2:
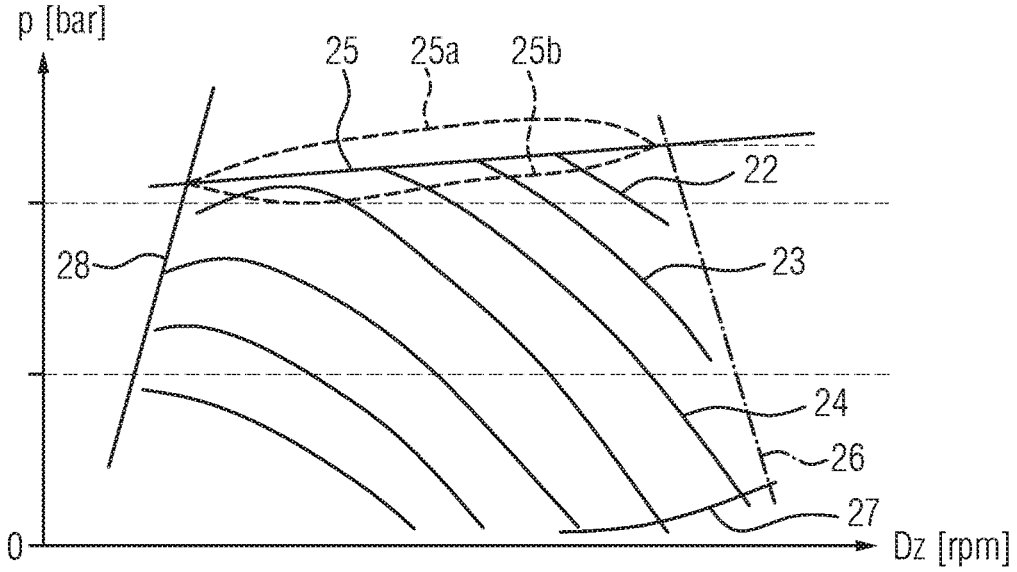
FIG. 2 shows a typical characteristic map of a fuel pump in conjunction with a diesel engine.

FIG. 2 illustrates a diagram in which the fuel pressure p in bar is plotted on the y axis versus the rotational speed on the x axis, measured in revolutions per minute. Multiple curves/characteristic curves 22, 23, 24 are shown, each of which represents a fixed current intensity value of the pump current, that is to say of the current which is fed to the electric motor which drives the pump. For each individual one of the characteristic curves 22, 23, 24, the relationship between the fuel pressure and the rotational speed of the pump is illustrated. The upper boundary line 25 of the diagram denotes, in simplified form and disregarding any hysteresis (see below), the triggering pressure of the reference valve 18, that is to say, as soon as the fuel pressure crosses the boundary in the direction of higher pressures, the reference valve opens, and the pump cannot generate any higher pressure.

The two dashed lines 25*a* and 25*b* are illustrated merely schematically and not to scale, and indicate triggering pressure values of the reference/calibration valve, with more detailed consideration being given to a hysteresis, that is to say, in the event of an increase of the pressure, the valve opens only in the presence of the higher of the two pressure values (lying on the line 25*a*), whereas in the event of a decrease of the pressure, the valve closes again in the presence of the relatively low pressure value (lying on the line 25*b*).

To expand the calibration possibilities, it is possible, in an overshoot process during overrun operation, to detect not only the triggering of the reference valve in the event of the pressure increase but also the switching pressure of the valve in the event of the pressure decrease, and thus, in a single process, to record two reference points in each case with pump rotational speed/pump volume flow and pump flow. The boundary line 26 denotes the maximum rotational speed that may be achieved by the pump, and the boundary line 27 denotes the values of the maximum delivery quantity that may be achieved by means of the pump, and the line 28 denotes the limit of the delivery quantity of the pump that cannot be undershot.

Corresponding characteristic maps in another representation but with the same information content also exist for lines of constant rotational speed of the pump, wherein, in this case, the current intensity is variable.

If, in the presence of constant rotational speed, the pressure is increased, the current intensity increases until the pressure reaches the line 25, or more specifically the line 25*a*. When the triggering pressure of the reference pump is reached, the set rotational speed of the pump, and the current intensity of the pump current attained at this point, are present, such that a data triplet composed of the three values pump current, rotational speed and pressure may be stored as a reference. For this purpose, it must furthermore be considered that the triggering pressure of the pump, illustrated by the lines 25, 25*a* and 25*b*, is dependent on the volume flow in the low-pressure circuit 39, that is to say also on the rotational speed of the pump, such that the triggering pressure may be corrected on the basis of the rotational speed and the pump current. However, it is initially necessary, as described above, for the volume flow, which is determined substantially by the bypass volume flow of the high-pressure pump 38, to be determined, which occurs in the course of the method according to the invention.

Measurements of different data triplets, that is to say different current intensities at different rotational speeds of the pump in each case upon the attainment of the triggering pressure of the reference valve (according to the invention, in the presence of a constant rotational speed of the pump), make it possible for the entire characteristic map to be calibrated.

Figure 3:
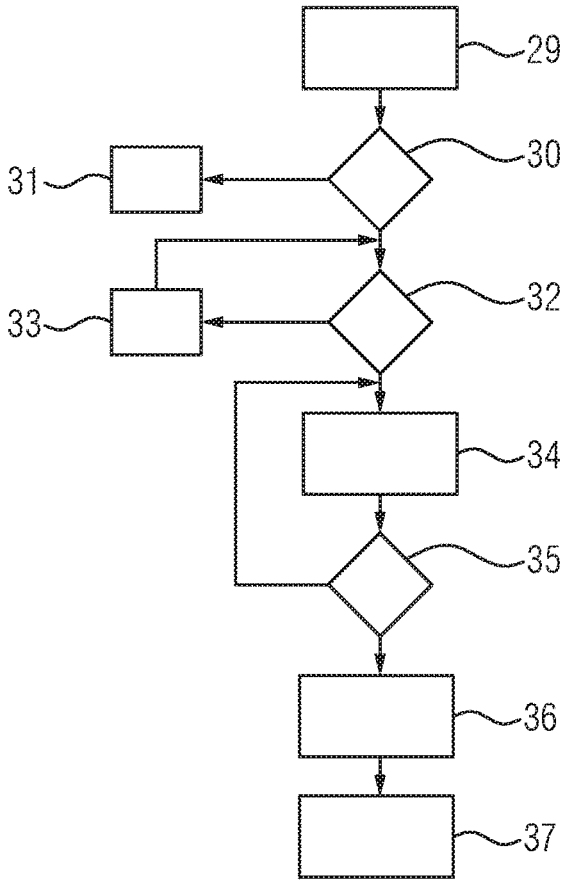
FIG. 3 shows a flow diagram of a process according to the invention.

The method according to the invention will be discussed by way of example for one possible embodiment on the basis of FIG. 3.

In an optional first step 29, it is signaled to the pump controller 13 or some other responsible module in an assembly of the vehicle that a change to overrun operation is presently taking place or has taken place. In the second step 30, it is checked whether the present rotational speed of the pump 7 lies above a minimum rotational speed required for the calibration.

If this is not the case, the calibration method is stopped by means of a transition to a termination step 31, and it is for example possible for the fuel pump to be run down to a low rotational speed which still provides the bypass volume of the high-pressure pump. If the rotational speed of the pump lies above the threshold value, then in the next method step 32, it is checked whether the present rotational speed of the pump is suitable for a calibration, and whether a calibration point already exists for the rotational speed. If the rotational speed is suitable for a calibration and if it is the case that no calibration measurement has yet been performed at the rotational speed, then a transition is made directly to step 34. If this is not the case, then in a method step 33, the rotational speed of the pump is changed slightly, is reduced to a preselected value and/or to a "round" value.

In the next method step 34, the electric pump current is then detected. This may be performed in small discrete steps or continuously. After every increase, it may be checked in the method step 35 whether a current increase has led to a pressure increase, or whether the reference valve has been triggered (significantly smaller current increase). If this is not determined directly by observing the load of the pump, then it may also be signaled by means of a sensor arranged at the calibration valve/reference valve.

If the current does not increase, or if a triggering of the reference valve is directly signaled, then a transition is made from the step 35 to a step 36, in which the data triplet composed of the current intensity of the pump current, the rotational speed and the triggering pressure of the reference valve, or a corrected value of the triggering pressure taking into consideration rotational speed and pump current, is stored. The variable required for the correction of the triggering pressure is the volume flow, which may be determined from the pump rotational speed, and which in turn influences the opening pressure of the calibration valve. Since the triggering/opening pressure of the calibration valve is dependent on the volume flow, the volume flow determined after attainment of the opening pressure may be used to correct the opening pressure of the calibration valve by means of an estimation.

The calibration measurement point is thereupon detected, and the rotational speed of the pump may, in the final method step 37, be reduced, to zero. The calibration measurement may be repeated later at other starting rotational speeds of the pump in order to collect a multiplicity of data triplets, which may together be used to correct a characteristic map which is stored in the region 15 of the control device 13.

In the method step 37, a data tuple, such as a data triplet, which comprises the rotational speed of the pump, the pump current and the triggering pressure, is additionally stored. The data form one of possibly several datasets, with the aid of which it is for example possible for a characteristic map of the fuel pump or a corresponding determination specification to be calibrated.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for operating an internal combustion engine, where fuel is supplied to the internal combustion engine, comprising the steps of:

providing a fuel pump, the fuel pump having a pressure side, and the fuel pump having a rotational speed and a pump current;

providing a high-pressure pump arranged between the fuel pump and the internal combustion engine;

providing a demand variable;

providing a calibration valve in fluid communication with the pressure side of the fuel pump, the calibration valve having a triggering pressure; and providing a determination specification which includes the triggering pressure of the calibration valve, the determined rotational speed of the fuel pump, a bypass volume flow of the high-pressure pump, and the determined pump current of the fuel pump;

controlling the rotational speed of the fuel pump and the pump current for feeding the fuel pump based on the demand variable;

changing the operating mode of the internal combustion engine to an overrun mode of operation;

performing a calibration which includes actuating the fuel pump during the calibration such that the pressure on the pressure side of the fuel pump increases, while detecting and maintaining the rotational speed of the fuel pump, and detecting the pump current and the bypass volume flow after the calibration valve has reached the trigger pressure.

2. The method of claim 1, further comprising the steps of:

providing an estimated pressure value on the pressure side of the fuel pump;

determining the bypass volume flow of the high-pressure pump based on the estimated pressure value and the rotational speed of the fuel pump after the triggering pressure of the calibration valve is reached during the calibration.

3. The method of claim 1, providing the steps of:

providing a temperature of the internal combustion engine; and providing a rotational speed of the internal combustion engine;

determining the bypass volume flow of the high-pressure pump based on the temperature and the rotational speed of the internal combustion engine.

4. The method of claim 1, further comprising the steps of determining the triggering pressure of the calibration valve based on the rotational speed of the fuel pump.

5. The method of claim 1, further comprising the steps of determining the triggering pressure of the calibration valve based on the bypass volume flow of the high-pressure pump.

6. The method of claim 1, further comprising the steps of maintaining constant pressure on the high-pressure side of the high-pressure pump during the calibration process.

7. The method of claim 1, further comprising the steps of:

providing a defined rotational speed threshold for the fuel pump;

determining the rotational speed of the fuel pump after the internal combustion engine has changed to the overrun mode of operation;

performing the calibration only when the defined rotational speed threshold has been exceeded.

8. The method of claim 7, further comprising the steps of deactivating the fuel pump and if the rotational speed of the fuel pump is less than the defined rotational speed threshold.

9. The method of claim 1, further comprising the steps of:

providing a predefined set of fixed values representing a plurality of rotational speeds of the fuel pump;

changing the rotational speed of the fuel pump during the calibration, such that that rotational speed of the fuel pump corresponds to one of the predefined set of fixed values.

10. The method of claim 9, further comprising the steps of changing the rotational speed of the fuel pump during the calibration, such that that the rotational speed of the fuel pump corresponds to one of the predefined set of fixed values that has not been used during the calibration.

11. The method of claim 10, further comprising the steps of reducing the rotational speed of the fuel pump during the calibration, such that that rotational speed of the fuel pump corresponds to one of the predefined set of fixed values that has not been used during the calibration.

12. The method of claim 1 or one of the following claims, further comprising the steps of:

providing a predefined minimum number of calibrations points;

determining whether the number of calibrations points has reached the predefined minimum number of calibration points after the determination of the pump current and the triggering of the calibration valve.

13. The method of claim 1, further comprising the steps of deactivating the fuel pump after completion of the calibration.

14. The method of claim 1, further comprising the steps of:

providing a plurality of calibration values obtained during the calibration;

changing the operation of the internal combustion engine as a result of a change in the demand variable such that the internal combustion engine is no longer in the overrun mode of operation;

ending the calibration as a result of the internal combustion engine no longer being in the overrun mode of operation;

determining to what extent the calibration has progressed;

assigning a weight to the plurality of calibration values.

15. The method of claim 1, further comprising the steps of;

providing a plurality of calibration values obtained during the calibration;

changing the operation of the internal combustion engine as a result of a change in the demand variable such that the internal combustion engine is no longer in the overrun mode of operation;

ending the calibration as a result of the internal combustion engine no longer being in the overrun mode of operation;

determining to what extent the calibration has progressed;

ignoring the plurality of calibration values obtained during the calibration.

16. The method of claim 1, further comprising the steps of:

providing a bus system; and providing a pump controller operable for controlling the fuel pump;

communicating the change to the overrun mode of operation of the internal combustion engine to the pump controller using the bus system.

* * * * *